US005288207A

United States Patent [19]

Linask

[11] Patent Number: 5,288,207

[45] Date of Patent: Feb. 22, 1994

[54] INTERNALLY COOLED TURBINE AIRFOIL

[75] Inventor: Indrik Linask, Tolland, Conn.

[73] Assignee: United Technologies Corporation, Hartford, Conn.

[21] Appl. No.: 980,849

[22] Filed: Nov. 24, 1992

[51] Int. Cl.[5] ..... F01D 5/18

[52] U.S. Cl. ..... 416/97 R

[58] Field of Search ..... 416/95, 97 R

[56] References Cited

U.S. PATENT DOCUMENTS

| | | | |
|---|---|---|---|
| 3,934,322 | 1/1976 | Hauser et al. | 416/97 R |
| 4,278,400 | 7/1981 | Yamarik et al. | 416/97 R |
| 4,407,632 | 10/1983 | Liang | 416/97 R |
| 4,515,523 | 5/1985 | North et al. | 416/97 R |
| 4,601,638 | 7/1986 | Hill et al. | 416/97 R |
| 4,752,186 | 6/1988 | Liang | 416/97 R |
| 4,753,575 | 6/1988 | Levengood et al. | 415/115 |
| 5,102,299 | 4/1992 | Frederick | 416/97 R |

FOREIGN PATENT DOCUMENTS

| | | | |
|---|---|---|---|
| 51902 | 3/1982 | Japan | 416/97 R |
| 197402 | 11/1983 | Japan | 416/97 R |

*Primary Examiner*—John T. Kwon

[57] ABSTRACT

A turbine airfoil having a baffleless cooling passage for directing cooling fluid toward a trailing edge is disclosed. Various construction details are developed which provide axially oriented, interrupted channels for turning a flow of cooling fluid from a radial direction to an axial direction. In a particular embodiment, a turbine airfoil has a cooling passage including a plurality of radially spaced walls, a plurality of radially spaced dividers downstream of the walls, and a plurality of radially spaced pedestals positioned axially between the walls and dividers. The walls and dividers define channels having an axial interruption permitting cross flow between adjacent channels. The cross flow minimizes the adverse affects of a blockage within a subchannel between adjacent walls. The pedestals are aligned with the subchannels such that cooling fluid exiting a subchannel impinges upon the pedestal.

12 Claims, 2 Drawing Sheets fig.3
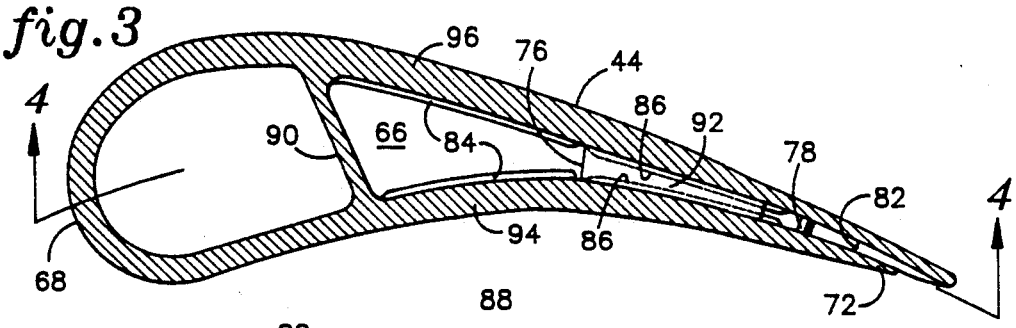
fig.4
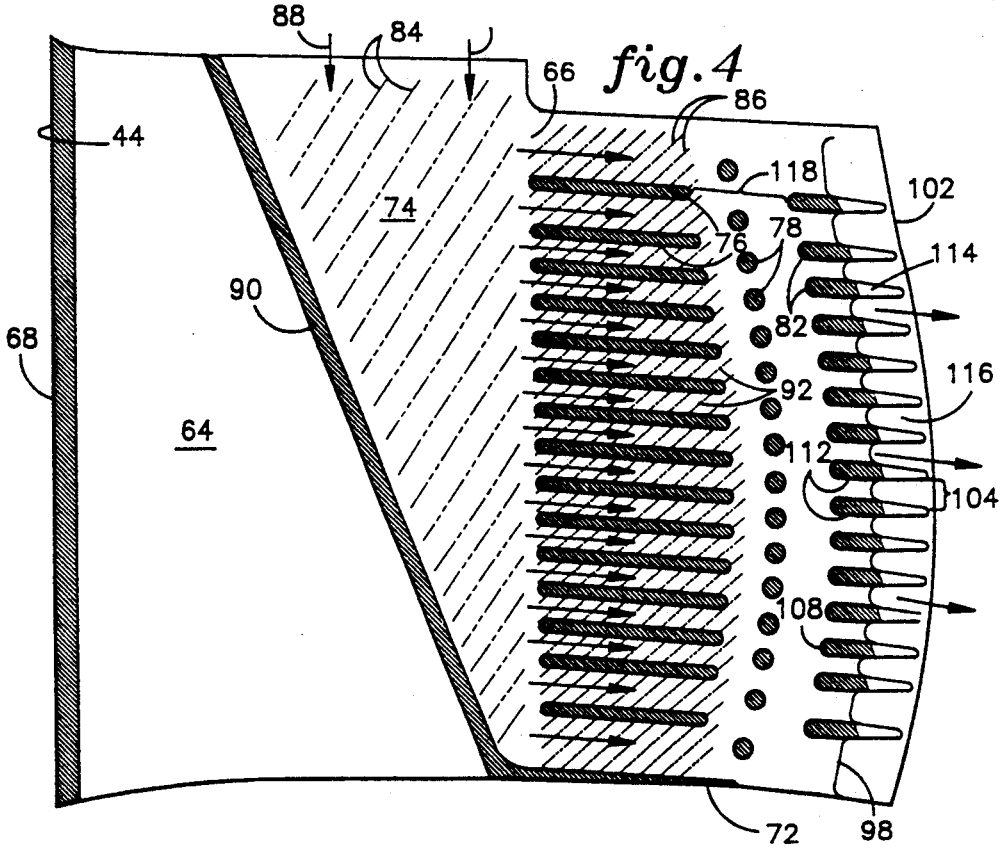
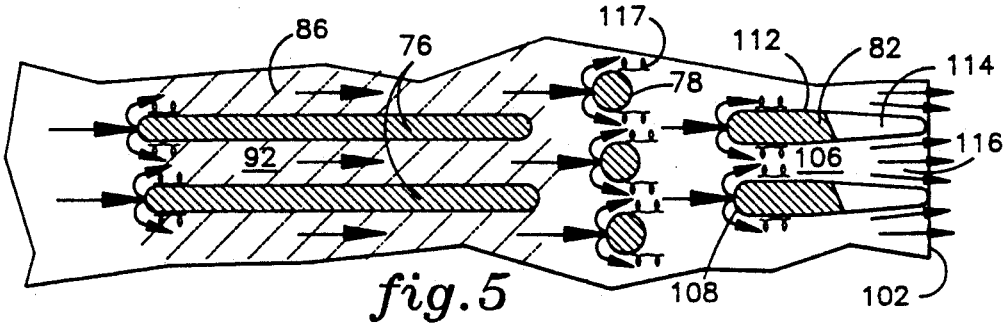
fig.5

INTERNALLY COOLED TURBINE AIRFOIL

TECHNICAL FIELD

This invention relates to gas turbine engines, and more particularly to turbine airfoils having internal cooling passages.

BACKGROUND OF THE INVENTION

A typical gas turbine engine has an annular axially extending flow path for conducting working fluid sequentially through a compressor section, a combustion section, and a turbine section. The compressor section includes a plurality of rotating blades which add energy to the working fluid. The working fluid exits the compressor section and enters the combustion section. Fuel is mixed with the compressed working fluid and the mixture is ignited to add more energy to the working fluid. The resulting products of combustion are then expanded through the turbine section. The turbine section includes another plurality of rotating blades which extract energy from the expanding fluid. A portion of this extracted energy is transferred back to the compressor section via a rotor shaft interconnecting the compressor section and turbine section. The remainder of the energy extracted may be used for other functions.

Efficient transfer of energy between the working fluid and the compressor and turbine sections is dependant upon many parameters. One of these is the orientation of the rotating airfoil relative to the flow direction of the working fluid. For this reason, a stage of non-rotating airfoils, referred to as vanes, are typically located upstream of a rotor blade stage. The vanes properly orient the flow for engagement with the blades. Another parameter is the size and shape of the airfoils, both blades and vanes. Typically the airfoils are aerodynamically optimized to efficiently transfer energy. Practical considerations, however, may restrict the size and shape to within certain constraints.

The amount of energy produced by the combustion process is proportional to the temperature of the combustion process. For a given fuel and oxidant, an increase in the energy of combustion results in an increase in the temperature of the products of combustion. The allowable temperature of the working fluid flowing through the turbine section, however, typically provides a temperature limit for the combustion process.

One method to prevent overheating turbine components is to cool the turbine section using cooling fluid drawn from the compressor section. Typically this is fluid which bypasses the combustion process and is thereby at a much lower temperature than the working fluid in the turbine section. The cooling fluid is flowed through and around various structure within the turbine section. A portion of the cooling fluid is flowed through the turbine airfoils, which have internal passageways for the passage of cooling fluid. As the cooling fluid passes through these passageways, heat is transferred from the turbine airfoil surfaces to the cooling fluid.

A detrimental result of using compressor fluid to cool the turbine section is a lower overall efficiency for the gas turbine engine. Since a portion of the compressed fluid is bypassing various stages of the turbine section, there is no transfer of useful energy from the compressor fluid to the bypassed turbine stages. The loss of efficiency is balanced against the higher combustion temperatures which can be achieved by cooling with compressor fluid. This balancing emphasizes the need to efficiently utilize the cooling fluid drawn from the compressor section. Efficient utilization of cooling fluid requires getting maximum heat transfer from a minimal amount of cooling fluid.

A common method of cooling a turbine vane utilizes an impingement tube or baffle disposed within the turbine vane. The baffle extends through the turbine vane and is in fluid communication with the source of cooling fluid. The baffle includes a plurality of impingement holes spaced about through which the cooling fluid passes. The cooling fluid exiting the baffle impinges upon the internal surfaces of the turbine vane. The arrangement of impingement holes distributes the cooling fluid within the turbine vane to prevent a deficiency in cooling from occurring in a particular location.

A drawback to using baffles is that the baffles present a limitation on the size and shape of the airfoil. First, the airfoil must be thick enough to permit insertion of the baffle within the airfoil. Second, complex shapes having 3-dimensional curvature are not practical as a result of having to insert the baffle into the airfoil.

The above art notwithstanding, scientists and engineers under the direction of Applicants' Assignee are working to develop efficient turbine airfoil cooling to maximize the overall efficiency of a turbomachine with minimal impact upon aerodynamic shape of the turbine airfoil.

DISCLOSURE OF THE INVENTION

According to the present invention, a turbine airfoil includes a baffleless passage defining a cooling fluid flow path including axially oriented, interrupted channels for distributing cooling fluid to a trailing edge.

According to a particular embodiment of the present invention, the channels include radially spaced walls extending between a pressure wall and a suction wall, flow dividers radially spaced along the trailing edge and axially spaced downstream of the walls, and pedestals disposed axially between the walls and dividers. The pedestals are radially offset from the walls such that fluid exiting a subchannel defined by an adjacent pair of walls impinges upon a pedestal. The dividers are radially offset from the pedestals such that fluid flowing between adjacent pedestals impinges upon a leading edge of a divider. The dividers extend axially over a suction wall lip and define diffusing means to provide film cooling of the lip.

A principle feature of the present invention is the baffleless cooling passage within the turbine airfoil. Another feature is the interrupted, axially extending channels. A feature of the specific embodiment is the pedestals positioned within the channels.

A primary advantage of the present invention is the aerodynamic optimization of the turbine airfoil which results from having a baffleless cooling passage. Without a baffle, the turbine airfoil may be sized without concern for having sufficient radial thickness to accommodate a baffle. In addition, the turbine airfoil may be shaped without limiting the 3-dimensional curvature of the aerodynamic shape to accommodate the insertion of a baffle. Another feature is the efficient use of cooling fluid within the turbine airfoil as a result of the channels. The channels radially distribute the cooling fluid and axially orient the flow of cooling fluid toward the trailing edge. Another advantage is the accommodation of the cooling configuration for blockages which may occur within the channels. Since the channels are interrupted, cooling fluid flowing through adjacent channels cross flows through the interruption and into the blocked channel, downstream of the blockage. The cross flow of fluid prevents hot spots from occurring along the trailing edge by minimizing the impact of blocked channels. An advantage of the particular embodiment is the efficient cooling within the channels as a result of the pedestals providing an impingement surface for cooling fluid within the channels. Cooling fluid exiting a subchannel impinges upon the pedestal. The impingement results in vortices being shed off the pedestal which transfers heat between the cooling fluid and adjacent turbine airfoil surfaces. The cooling fluid flowing between adjacent pedestals then impinges upon the leading edge of the dividers to further transfer heat.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 3 is a cross-sectional view taken along line 3—3 of FIG. 2 of a turbine vane.

FIG. 4 is a sectional view, taken along line 4—4 of FIG. 3, of the turbine vane, partially cut-away to show a cooling passage, including trip strips, walls, pedestals, and dividers.

FIG. 5 is a view of adjacent channels with arrows indicating the direction of flow of cooling fluid.

BEST MODE FOR CARRYING OUT THE INVENTION

Figure 1:
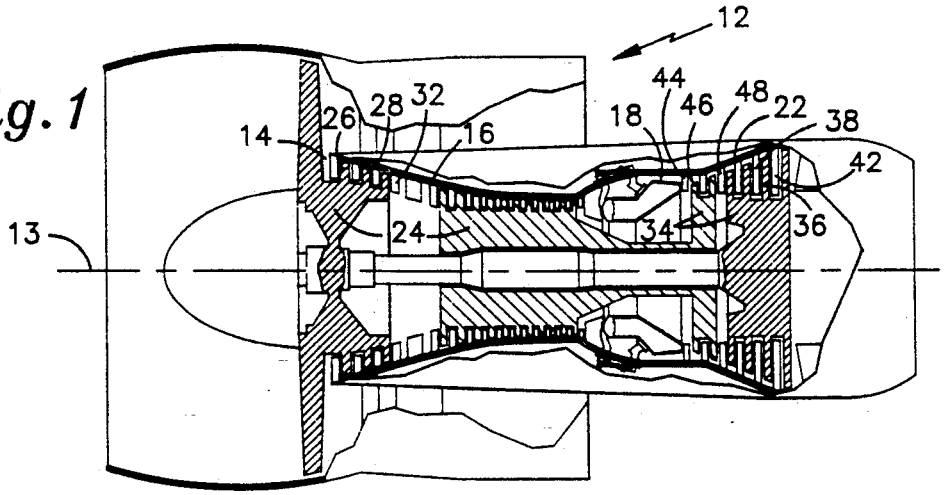
FIG. 1 is a cross-sectional side view of a gas turbine engine.

FIG. 1 is an illustration of a gas turbine engine 12 shown as a representation of a typical turbomachine. The gas turbine engine includes an axially directed flow path 14, a compressor 16, a combustor 18, and a turbine 22. The axially directed flow path defines a passage for sequentially flowing working fluid through the compressor, combustor and turbine. The compressor includes a rotor assembly 24 having a plurality of rotating blades 26 and a stator assembly 28 having a plurality of vanes 32. The turbine also includes a rotor assembly 34 having a plurality of turbine blades 36 and a stator assembly 38 having a plurality of turbine vanes 42. The turbine is downstream of the combustor and therefore is exposed to hot working fluid exiting the combustor. A portion of the working fluid exiting the compressor bypasses the combustion process and is flowed into the turbine to function as cooling fluid.

Figure 2:
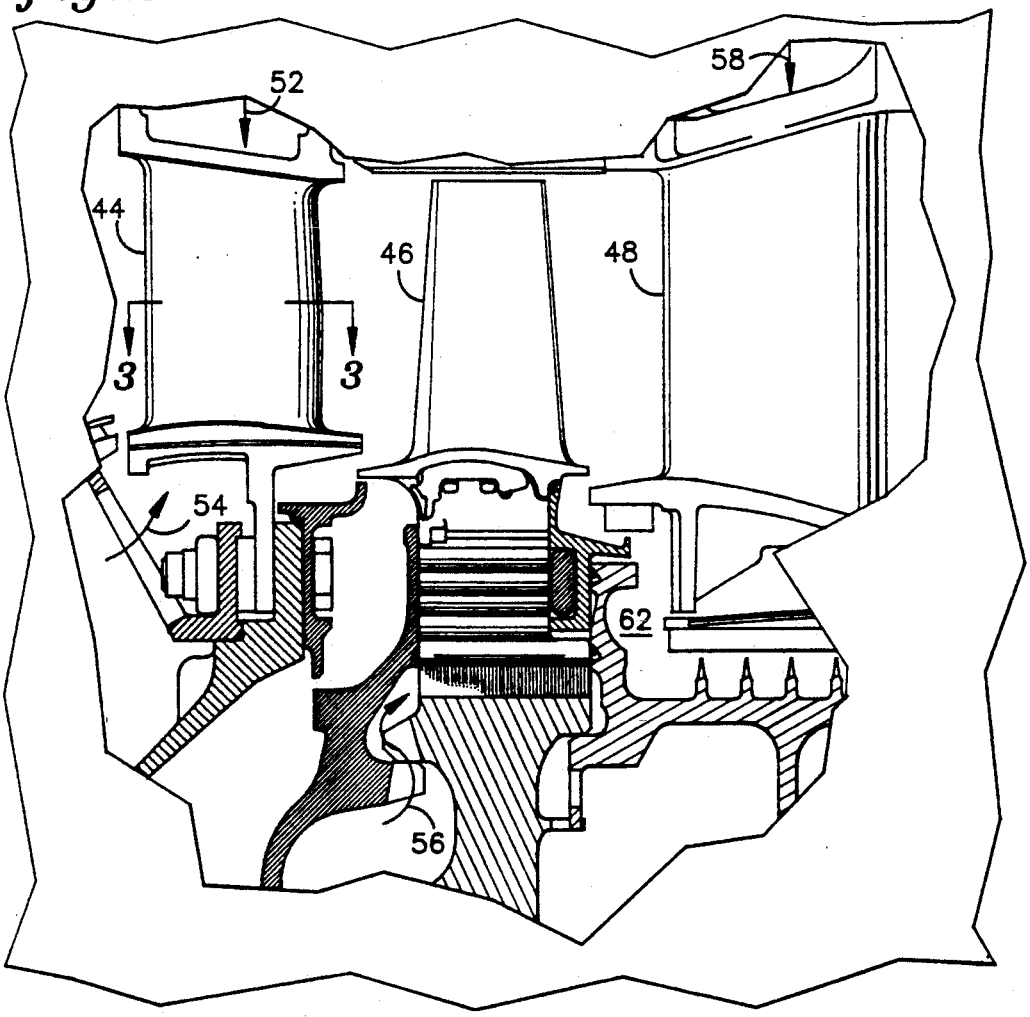
FIG. 2 is a partially sectioned side view of an upstream turbine vane assembly, a turbine blade assembly, and a downstream turbine vane assembly.

FIG. 2 illustrates a first stage turbine vane 44, a first stage rotor blade 46, and a second stage turbine vane. The first stage turbine vane is directly exposed to the hot working fluid exiting the combustor. The first stage turbine vane provides means to orient the flow of working fluid for optimal engagement with the first stage turbine blade. To maintain the temperature of the first stage turbine vane fluid within acceptable levels cooling fluid is flowed radially inward and radially outward, as shown by arrows 52,54, through the hollow turbine vane. This cooling fluid flows through internal passages within the turbine vane to provide cooling and exits through cooling holes disposed about the turbine vane to provide additional cooling over the surfaces of the turbine vane. The turbine blade engages the working fluid to transfer energy from the working to the turbine blade. The transferred energy causes the turbine blade and rotor assembly to rotate about the longitudinal axis 13 of the gas turbine engine. Cooling fluid is flowed radially outward, as shown by arrow 56, through passages in the rotor assembly and into the turbine blade. As with the turbine vane, the cooling fluid flows through passages within the turbine blade and exits through cooling holes, not shown, in the turbine blade. The cooling fluid provides convective cooling to the turbine blade as it flows through the passages and film cooling over the surfaces of the turbine blade after it exits through the cooling holes. The second stage turbine vane is similar to the first stage turbine vane in that it provides means to orient the flow of working fluid for optimal engagement with a downstream rotor blade. Although not exposed to working fluid with temperatures as extreme as the first stage turbine vane, the second stage turbine vane also requires cooling. This cooling is provided by a radially inward flow of cooling fluid, as shown by arrow 58, flowing into the hollow turbine vane and through passages within the turbine vane. A portion of this cooling fluid exits through cooling holes (not shown) within the turbine vane and the remainder exits through a cooling fluid ejector disposed radially inward of the turbine vane to provide cooling to a seal cavity 62.

FIGS. 3 and 4 are sectional views of the first stage turbine vane 44. The first stage turbine vane is shown as an example of a turbine airfoil having the present invention incorporated therein. As shown in FIG. 3, the turbine vane has two internal passages for the flow of cooling fluid. The first passage is in fluid communication with the radially outward flow of cooling fluid and provides cooling to a leading edge portion 68 of the turbine vane. The second passage, the trailing edge cooling passage, is in fluid communication with the radially inward flow of cooling fluid and provides cooling to a trailing edge portion of the turbine vane 72. As the present invention relates to trailing edge cooling, the first passage will not be described in any further detail.

The trailing edge cooling passage includes a plenum 74, a plurality of axially extending walls 76, a plurality of pedestals 78, and a plurality of dividers 82. The trailing edge cooling passage further includes a first plurality of trip strips 84 exposed in the plenum and a second plurality of trip strips 86 disposed about the walls.

The plenum is a source cavity for cooling fluid flowing through the plurality of walls. The plenum is in fluid communication with a source of cooling fluid as indicated by the arrows 88. Cooling fluid flows through the plenum with a positive but low velocity. The plenum includes a radially canted partition 90 which is a common barrier between passages. The canted partition provides means to radially converge the plenum in the direction of cooling flow to maintain an approximately constant flow velocity through the plenum. The convergence facilitates radial distribution of the cooling flow and ensures heat transfer.

The walls are radially spaced apart and axially parallel to one another. Adjacent walls define subchannels 92 therebetween. The walls extend laterally between a pressure wall 94 and a suction wall 96 of the airfoil. The second plurality of trip strips are disposed along the surfaces of the pressure wall and suction wall and are evenly distributed through the subchannels.

The pedestals 78 are radially spaced apart and extend laterally between the pressure wall and suction wall. Each of the pedestals is disposed downstream of an radially aligned with one of the subchannels. In this way, each of the pedestals provides an obstruction in the flow exiting each of the subchannels. As shown in FIG. 4, each of the pedestals is circular in cross section and equal in radial dimension. Although shown this way, it should be apparent to those skilled in the art that a mixture of pedestals of various shapes and sizes may be used.

The dividers 82 are radially spaced and disposed downstream of both the walls and the pedestals. The dividers extend from a point upstream of a pressure wall lip 98 to downstream over a suction wall lip 102. Each of the dividers is aligned with one of the walls. The plurality of dividers and walls define a plurality of channels 104 directing cooling fluid towards the trailing edge. Each of the channels includes the subchannel 92 between adjacent walls and a second subchannel 106 between adjacent flow dividers. Each flow divider includes a leading edge 108, a constant thickness portion 112, and a convergent portion 114. Adjacent convergent portions define a diffusing section 116 within each of the second plurality of subchannels.

During operation, hot working fluid flows over the outer surfaces of the turbine vane and results in heating the turbine vane. Cooling fluid is flowed into the turbine vane in a radially inward and a radially outward direction. The cooling fluid flowing radially inward enters the plenum and engages the first plurality of trip strips. Within the plenum the cooling provides convective cooling of the pressure wall and suction wall. As shown in FIG. 5, the cooling fluid then flows through the plurality of walls which provide means to turn the flow from a radial direction to an axial direction and towards the trailing edge of the turbine vane. Within the first plurality of subchannels defined by the walls, cooling fluid flows over the second plurality of trip strips. Within the subchannels, heat is transferred between the cooling fluid and the walls, pressure surface, and suction surface. Cooling fluid exiting the subchannels impinges upon one of the pedestals disposed downstream of the subchannel. The impingement results in heat being transferred between the pedestal and the cooling fluid and also results in vortices 117 being generated in the flow flowing past the pedestals. The vortices generated result in additional heat transfer from the turbine vane to the cooling fluid. The cooling fluid flowing around the pedestals then impinges upon the leading edge of the dividers. This impingement again results in heat transfer and in the generation of flow vortices. Cooling fluid flowing into the second plurality of subchannels is diffused over the trailing edge of the turbine vane. By diffusing the cooling fluid, the velocity of the exiting cooling fluid is lowered to reduce the likelihood of separation of the cooling fluid from the trailing edge.

The axial spacing between the radially aligned walls and dividers defines an interruption 118 in each of the channels. The interruptions permit cross flow between channels. The cross flow ensures that, in the event that one of the first plurality of subchannels becomes blocked, cooling fluid will continue to be distributed over the radial extent of the trailing edge. The cross flow through the interruption provides a means to backfill each of the second plurality of subchannels which is downstream of a blocked first subchannel. In addition, each of the pedestals provides an obstruction within the channel which encourages cross flow between channels and facilitates distribution of cooling flow to the trailing edge.

Although FIGS. 3 and 4 disclose the invention as applied to a first stage turbine vane, it should be readily apparent to those skilled in the art that the invention is equally applicable to other turbine airfoils, including turbine blades. In addition, the first stage turbine vane shown in FIGS. 3 and 4 discloses a turbine vane having a source of cooling fluid flowing radially inward and another source of cooling fluid flowing radially outward through the turbine vane. It should be readily apparent to those skilled in the art that the invention may also be applied to turbine airfoils having a single source of cooling fluid wherein the cooling fluid flows through a serpentine passage through the blade before reaching the trailing edge region.

Although the invention has been shown and described with respect with exemplary embodiments thereof, it should be understood by those skilled in the art that various changes, omissions, and additions may be made thereto, without departing from the spirit and scope of the invention.

What is claimed is:

1. A turbine airfoil for a gas turbine engine having a longitudinal axis and a source of cooling fluid, the turbine airfoil having a pressure wall, a suction wall, a trailing edge and a cooling fluid flow passage, the cooling fluid flow passage in fluid communication with the source of cooling fluid and providing means for directing cooling fluid to the trailing edge, the flow passage including:

a plurality of axially extending walls, each of the walls extending laterally between the pressure wall and suction wall, the plurality of walls being radially spaced within the flow passage such that adjacent pairs of walls define a subchannel, wherein the plurality of walls turn the flow of fluid towards the trailing edge;

a plurality of axially extending dividers, each of the dividers extending laterally between the pressure wall and the suction wall, being axially spaced downstream of one of the walls, and extending over the trailing edge, the plurality of dividers being radially spaced within the flow passage such that a second plurality of subchannels is defined between adjacent dividers, wherein the walls and dividers define a plurality of axially extending flow channels, a plenum upstream of the plurality walls, the plenum defined in part by the pressure wall, the suction wall, and a radially canted partition extending therebetween, wherein the plenum defines a converging passage in the direction of flow of the cooling fluid entering the flow passage, wherein the converging passage maintains a positive flow velocity through the plenum to evenly distribute cooling fluid to the flow channels; and wherein the axial spacing between the walls and the dividers defines an interruption within the channels, the interruption permitting cross flow of the cooling fluid flowing through adjacent channels.

2. The turbine airfoil according to claim 1, wherein each of the dividers is radially aligned with one of the walls such that each of the second plurality of subchannels is radially aligned with one of the first plurality of subchannels.

3. The turbine airfoil according to claim 2, further including a plurality of radially spaced pedestals, each of the pedestals disposed axially between the walls and the dividers, and wherein each pedestal is radially aligned with one of the first plurality of subchannels such that cooling fluid exiting one of the subchannels impinges upon one of the pedestals, wherein the impingement is adapted to transfer heat from the pedestals to the cooling fluid, to generate vortices in the flow of cooling fluid flowing past the pedestals, and to facilitate cross flow between each of the first plurality of subchannels and at least one of the second plurality of subchannels.

4. The turbine airfoil according to claim 2, wherein each of the dividers includes a downstream end which radially converges such that adjacent dividers define a diffusing section within each of the second subchannels, each of the diffusing sections extending axially over the trailing edge and being radially aligned with one of the flow channels.

5. The turbine airfoil according to claim 4, further including a plurality of trip strips disposed within the flow channels, the trip strips adapted to trip the flow of cooling fluid within the channels such that the rate of heat transfer between the cooling fluid and the surfaces of the channel is increased immediately downstream of the trip strip.

6. The turbine airfoil according to claim 1, further including a plurality of trip strips disposed within the flow channels, the trip strips adapted to trip the flow of cooling fluid within the channels such that the rate of heat transfer between the cooling fluid and the surfaces of the channel is increased immediately downstream of the trip strip.

7. A turbine airfoil for a gas turbine engine having a longitudinal axis and a source of cooling fluid, the turbine airfoil having a trailing edge and a cooling fluid flow passage, the cooling fluid flow passage in fluid communication with the source of cooling fluid and providing means for directing cooling fluid to the trailing edge, the flow passage including:

a plurality of axially extending walls, the walls being radially spaced within the flow passage, wherein the plurality of walls turn the flow of fluid towards the trailing edge;

a plurality of axially extending dividers, each of the dividers spaced downstream of one of the walls, the dividers being radially spaced within the flow passage, wherein the walls and dividers define a plurality of axially extending flow channels, and wherein the axial spacing between the walls and the defines an interruption within the channels, the interruption permitting cross flow of the cooling fluid flowing through adjacent channels; and a plurality of trip strips disposed within the flow channels, the trip strips adapted to trip the flow of cooling fluid within the flow channels such that the rate of heat transfer between the cooling fluid and the surfaces of the channel is increased immediately downstream of the trip strip.

8. The turbine airfoil according to claim 7, further including a plurality of radially spaced pedestals, each of the pedestals disposed axially between the walls and the dividers, wherein adjacent pairs of walls define a subchannel, and wherein each pedestal is radially aligned with one of the subchannels such that cooling fluid exiting the subchannel impinges upon the pedestal, the impingement adapted to transfer heat from the pedestals to the cooling fluid and to generate vortices in the flow of cooling fluid flowing past the pedestals.

9. The turbine airfoil according to claim 8, wherein each of the dividers is radially aligned with one of the walls, wherein a second plurality of subchannels is defined between adjacent dividers, and wherein each of the pedestals is radially aligned with one of the second plurality of subchannels.

10. The turbine airfoil according to claim 9, wherein each of the dividers includes a downstream end which radially converges such that adjacent dividers define a diffusing section of the second subchannel, the diffusing section extending axially over the trailing edge.

11. The turbine airfoil according to claim 10, wherein the cooling fluid enters the flow passage with a flow direction, wherein the flow passage further includes a plenum upstream of the plurality of walls, and wherein the plenum defines a converging passage in the direction of flow of the cooling fluid entering the cooling passage.

12. The turbine airfoil according to claim 7, wherein the cooling fluid enters the flow passage with a flow direction, wherein the flow passage further includes a plenum upstream of the plurality of walls, and wherein the plenum defines a converging passage in the direction of flow of the cooling fluid entering the cooling passage.

* * * * *